US007766635B2

(12) United States Patent
Langer

(10) Patent No.: US 7,766,635 B2
(45) Date of Patent: Aug. 3, 2010

(54) ROTARY PUMP HAVING SINUSOIDAL SEALING LINES

(75) Inventor: Gerd Langer, Rayreuth (DE)

(73) Assignee: Herold & Co. GmbH, Gefrees (DE)

( * ) Notice: Subject to any disclaimer, the term of this patent is extended or adjusted under 35 U.S.C. 154(b) by 0 days.

(21) Appl. No.: 11/850,319

(22) Filed: Sep. 5, 2007

(65) Prior Publication Data

US 2008/0056927 A1 Mar. 6, 2008

(30) Foreign Application Priority Data

Sep. 5, 2006 (DE) ..... 10 2006 041 633

(51) Int. Cl.
*F03C 2/00* (2006.01)
*F04C 18/00* (2006.01)

(52) U.S. Cl. ..... 418/201.1; 418/77; 418/206.4; 418/206.6

(58) Field of Classification Search ..... 418/75, 418/77, 189, 201.1, 201.3, 206.1, 206.4, 418/206.5, 104, 206.6
See application file for complete search history.

(56) References Cited

U.S. PATENT DOCUMENTS 1,142,734 A 6/1915 Sidwell
3,817,667 A * 6/1974 Winkelstrater et al. ... 418/206.5
5,039,289 A * 8/1991 Eiermann et al. ..... 418/206.5
5,152,684 A * 10/1992 Steffens ..... 418/206.5
7,320,579 B2 * 1/2008 Hirano et al. ..... 418/206.1

FOREIGN PATENT DOCUMENTS

| | | | |
|---|---|---|---|
| DE | 3502839 | A1 | 7/1986 |
| DE | 4121684 | A1 * | 1/1993 |
| DE | 102005017575 | A1 | 3/2006 |
| EP | 0363420 | B2 | 4/1990 |
| GB | 382953 | | 11/1932 |
| WO | 0161151 | A1 | 8/2001 |

* cited by examiner

*Primary Examiner*—Theresa Trieu
(74) *Attorney, Agent, or Firm*—Browdy and Neimark, PLLC

(57) ABSTRACT

A rotary pump has a housing composed of two intersecting cylinder sections and pump rotors therein. The rotors roll off on one another and against the interior wall of the housing in a sealing manner and have two approximately club-shaped sections that are connected to each other at their narrower ends via a waisting. The club-shaped section of one rotor engages into the waisting of the other rotor. The rotors create in each phase of the rotation movement an evenly increasing intake volume in front of the inlet port and an evenly decreasing discharge volume in front of the outlet port, provision is made that, in order to improve the pumping performance and increase the stability under load, the surface lines, which function as sealing lines are designed sine shaped.

5 Claims, 5 Drawing Sheets

ROTARY PUMP HAVING SINUSOIDAL SEALING LINES

BACKGROUND OF THE INVENTION

1. Field of the Invention

The invention relates to a pump with a housing composed of two intersecting cylinder sections, having provided on mutually opposite sides inlet and outlet ports and having in each cylinder section a rotor rotatably disposed about its center longitudinal axis, the major transverse axes of the rotors being positioned approximately perpendicular to each other in at least one movement phase, and the rotors rolling off on one another and against the interior wall of the housing in a sealing manner, the surface lines of each rotor that extend from the intersection of the major transverse axes extending in opposite directions obliquely to the respective center longitudinal axis, and each rotor having two approximately club-shaped sections that are connected to each other at their narrower ends via a waisting, the rotors having a configuration and being disposed relative to each other such that when the major transverse axes of the two rotors are positioned perpendicular to each other, the club-shaped section of one rotor engages into the waisting of the other rotor and the two rotors roll off on one another in a sealing manner, the rotors creating in each phase of the rotation movement an evenly increasing intake volume in front of the inlet port and an evenly decreasing discharge volume in front of the outlet port.

2. Background Art

A pump of this generic type is known from EP 0 363 420 B2.

Such pumps, the generic type of which is assumed to be known, are referred to as Roots pumps or Roots housings and they have proven effective in practice for quite some time.

The rotors of conventional Roots pumps of this type have circumferential surfaces that extend parallel to the center longitudinal axis of the rotor and thus perpendicular to the flow direction that is defined by the inlet and outlet ports. Due to this design of conventional pumps of this type, the pumped medium pulsates relatively strongly in dependence upon the respective rotation angle position of the rotors.

From GB-A-382 953 a pump of the generic type is known in which, however, due to the rotor configuration that is proposed there, an increased pump resistance must be accepted due to occurrences of fluid compression in dead spaces.

From DE-A-35 02 839 a pump with two rotors is known that have two mutually parallel axes of rotation, wherein the sealing surfaces extend obliquely to the axes of rotation in each case. In this prior-art pump the inlet and outlet port are disposed in the axial extension of the axes of rotation. The configuration of the rotors is relatively complicated.

U.S. Pat. No. 1,142,734 describes a pump with two rotors, which, in cross-section, have a club-shaped intermeshing configuration. The outlet and inlet port in this design are disposed on one hand in the region of the front ends and on the other hand on the opposite side approximately in the center of the housing The helical rotors, viewed in the longitudinal direction, are composed of two partial rotors, wherein the curvature of the two partial rotors changes in the region of the perpendicular bisector. The medium that is to be pumped is accordingly pumped substantially in the axial direction from the outsides to the center.

SUMMARY OF THE INVENTION

With this as the starting point, the invention is based on the object of improving a pump of the type mentioned at the outset while preserving its principal advantages in such a way that a pulsation-free, even flow of the medium being transported is achieved at a high delivery capacity while preventing dead spaces, particularly also making it possible to pump in a largely wear-resistant manner abrasive media as they occur, for example, in the sugar industry, or products of the dairy and cheese industry.

This object is met according to the invention in such a way that the surface lines that function as sealing lines are designed sinusoidal.

The inventive sine or cosine shaped surface lines may be designed linear in the geometric sense in a first embodiment, such an embodiment being particularly suitable for pumping products of the sugar industry.

In an alternative embodiment the surface lines are widened to form band-like sealing surfaces. This embodiment is suitable for dairy and cheese products.

In a further improvement of the invention, provision is made that in the latter embodiment, viewed in the cross-section of the rotors, concave depressions are formed on both sides of the major longitudinal axis and on both sides of the minor longitudinal axis, respectively.

Advantageously disposed in each case is an inlet port on the inlet side and an outlet port situated exactly opposite and laterally inversely flush with the inlet port.

The inlet and outlet port may advantageously be designed triangular or trapezoidal.

A particularly advantageous flow pattern is obtained in such a way that the legs or lateral edges of the inlet port and outlet port are configured sine and cosine shaped, respectively.

In summary it may be stated regarding the inventive solution that the acute-angled edges of the rotors or pistons are reduced to 90° angles. This results in reduced wear in this region, thus minimizing pressure losses and increasing the serviceable life. Additionally, a front-end coupling of two rotors with sine and cosine shape is possible, which double the delivery rate with the same power head. Since the transition from one rotor to the other is rounded and has no acute angles, the wear and tear is reduced to a minimum.

The wobble stress that is caused by the helically guided flow is largely compensated and the alternating stress on seal and bearing is minimized. The nearly pulsation-free flow pattern is optimized further as well.

Advantages are also derived from a delivery flow that is even more gentle on the media. Solid ingredients and shear-sensitive products are no longer entrapped in a wedge shape in the frontal region of the displacement chamber but pushed forward at a right angle relative to the frontal area.

The invention will be explained in more detail below based on a preferred exemplary embodiment in conjunction with the drawing.

DESCRIPTION OF THE PREFERRED EMBODIMENT

Figure 1:
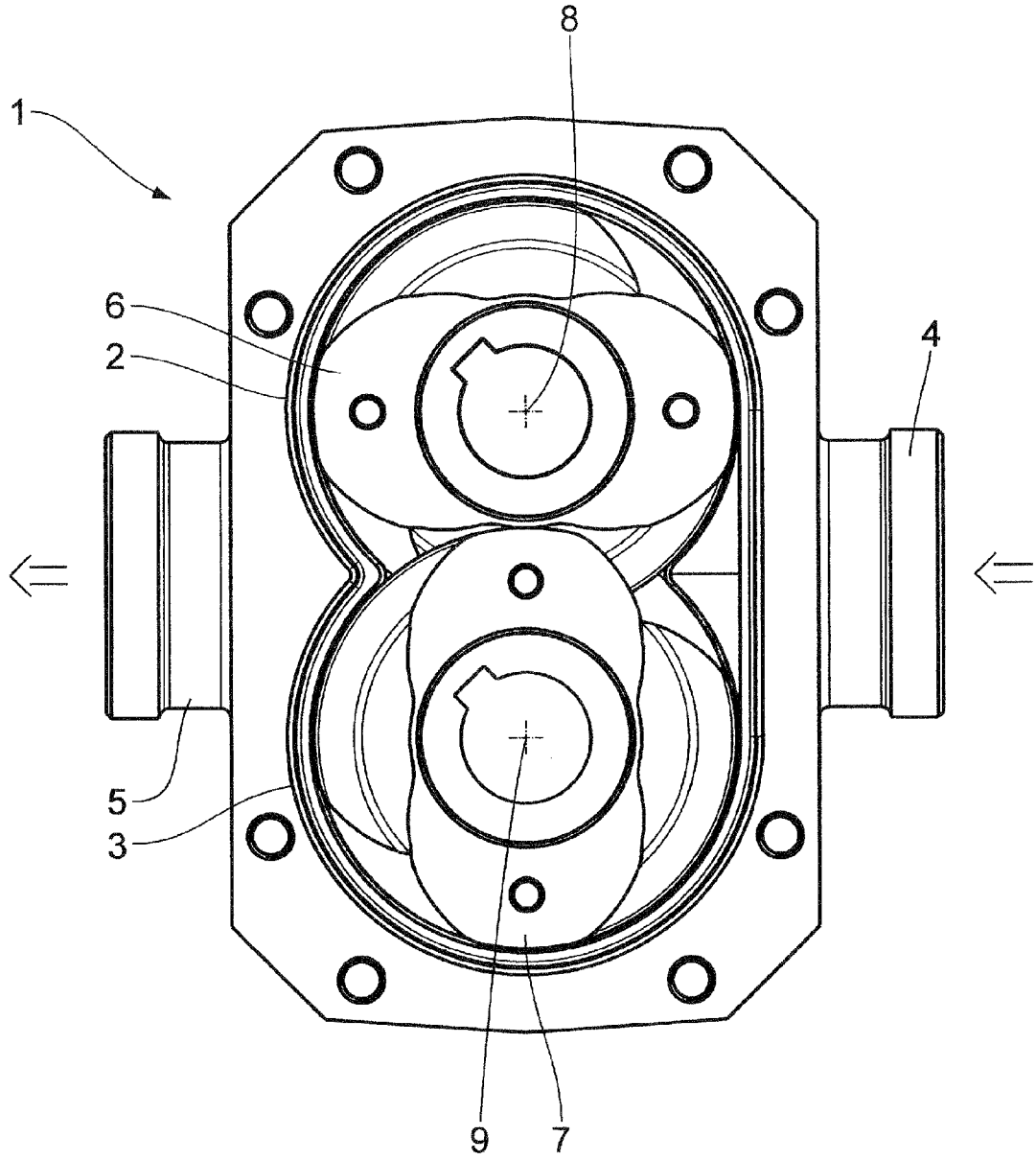
FIG. 1 shows a view of a frontally opened inventive pump.

A pump shown in the drawing has a pump housing 1 consisting of two intersecting cylinder sections 2, 3.

In the intersecting region of the cylinder sections 2, 3, an inlet port 4 and an outlet port 5 are provided at the circumferential cylinder surface. The inlet port 4 and the outlet port 5 are diametrically opposed to each other and have an approximately trapezoidal cross-section.

Disposed in the interior of each cylinder section 2, 3 is a rotor 6 or 7, respectively, whose center longitudinal axes 8 and 9 extend parallel to the center longitudinal axis of the respective cylinder section 2 or 3.

The rotors 6 and 7 are rotatably driven about their respective center longitudinal axes 8 and 9 in opposite directions (arrows 10, 11). The coordinated actuation of both rotors 6, 7 can be achieved in a manner that is known per se, for example by means of intermeshing gearwheels that are disposed on the rotor shafts 8, 9.

Each rotor 6, 7, viewed in cross-section, has an approximately oval shape and, viewed in the longitudinal direction, is coiled, i.e., helically twisted about the longitudinal axis. This coil-shape is designed in such a way that surface lines 12 are created that extend sinusoidally.

Figure 2:
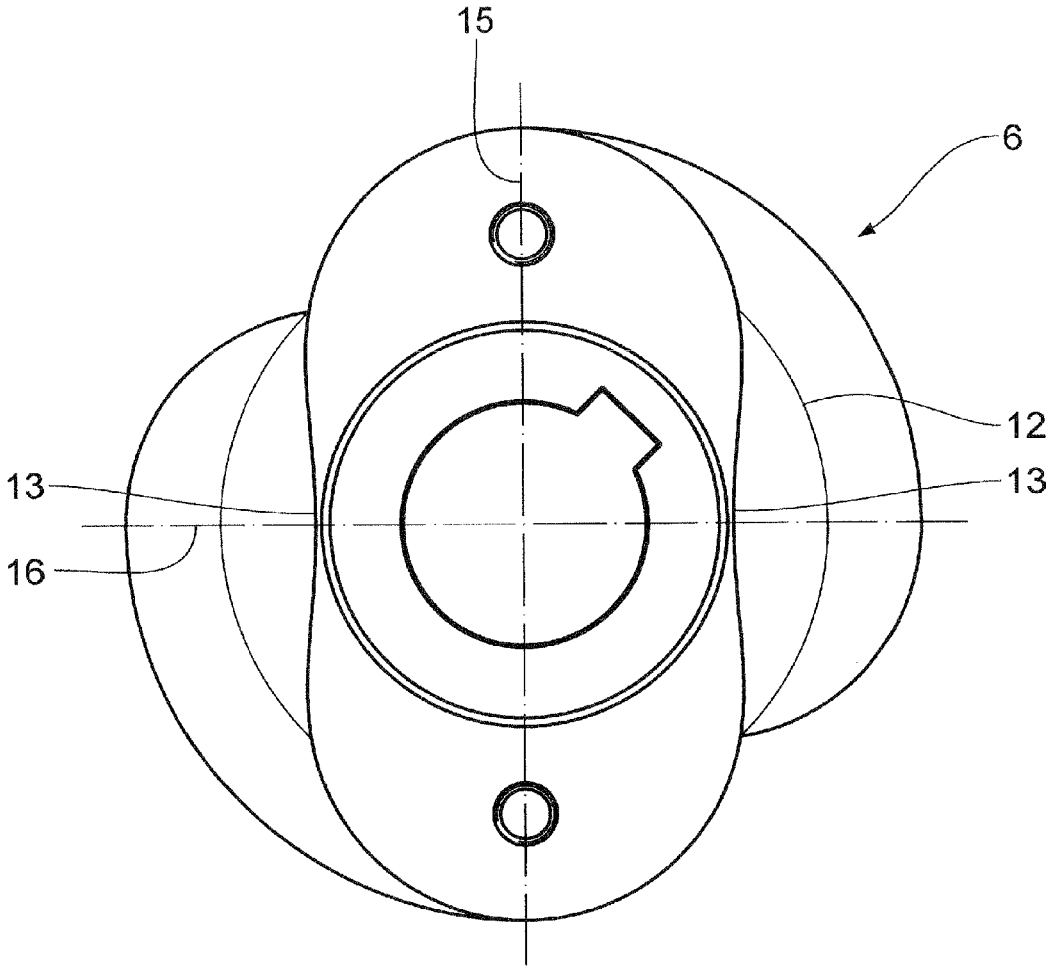
FIG. 2 shows a front view of a first embodiment of an inventive rotor.

In the exemplary embodiment according to FIG. 2, these surface lines are designed linear in the geometrical sense. The rotors 6, 7 in this exemplary embodiment, viewed in cross-section, have two opposed lateral concave depressions 13. This embodiment is suitable for pumping abrasive media, as they occur, for example, in the sugar industry.

Figure 3:
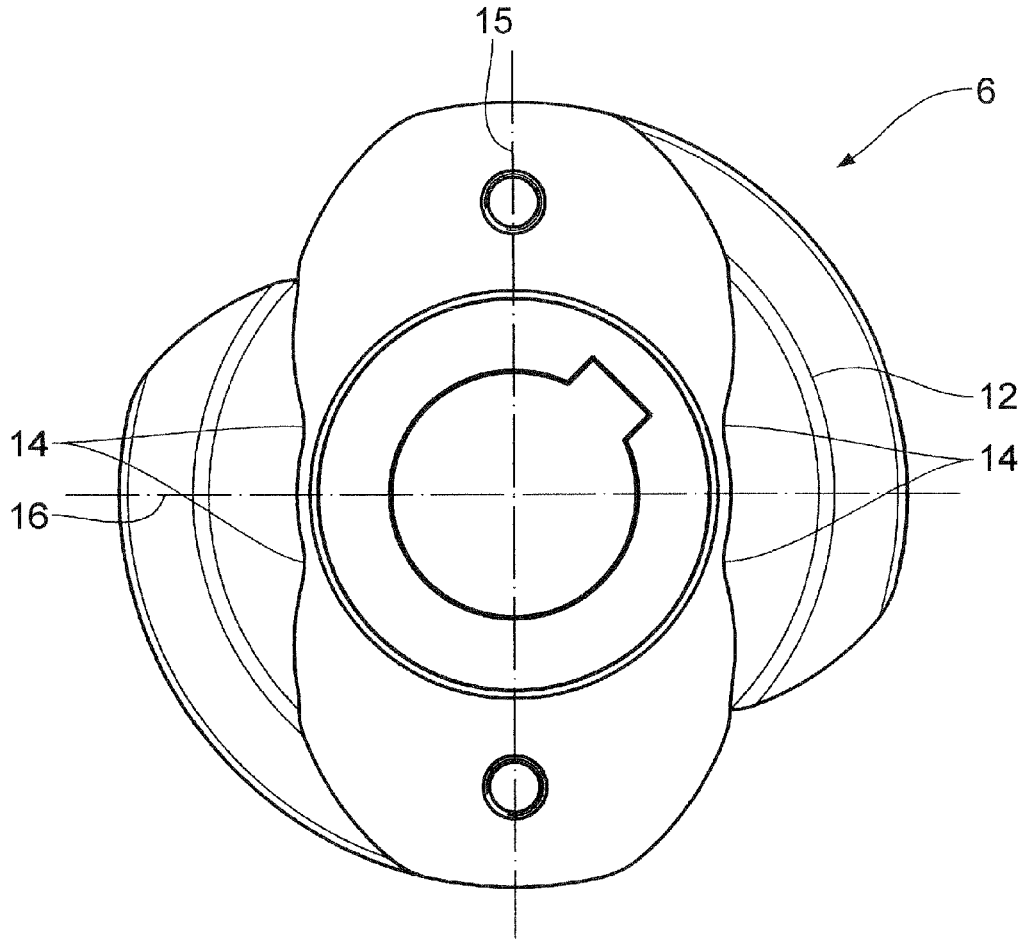
FIG. 3 shows a view corresponding to FIG. 2 of a second embodiment.
Figure 4:
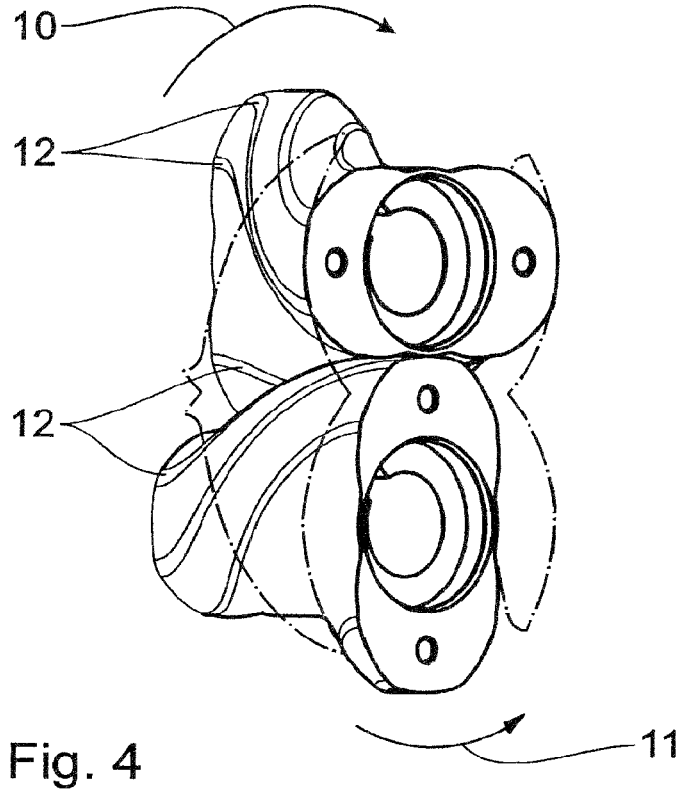
FIGS. 4 and 5 show perspective views in each case of two inventive rotors rolling off on one another in different relative positions.
Figure 5:
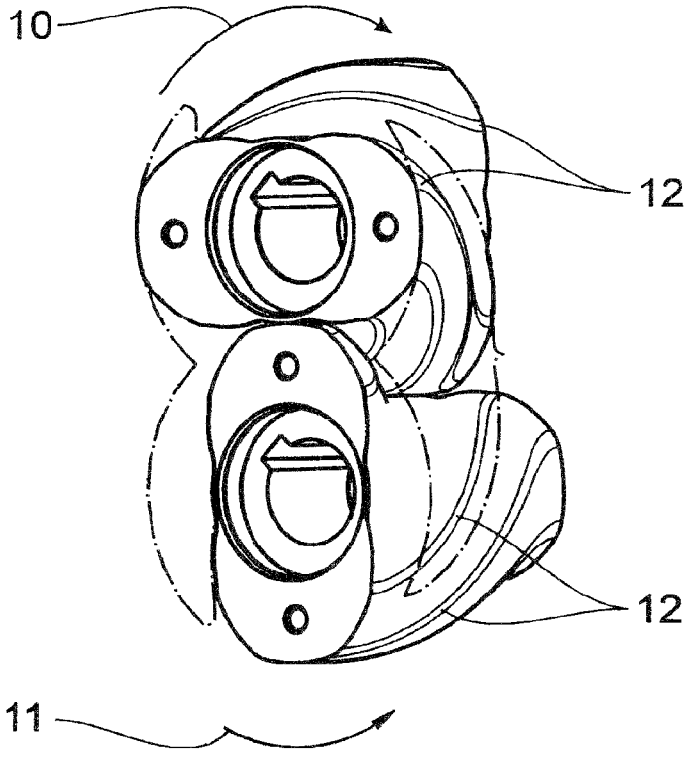

In the embodiment according to FIG. 3 the sinusoidal surface lines are designed widened in a band-like manner. Viewed in cross-section, this embodiment has provided on each side two indentations 14, which are alternatingly opposed relative to the major center longitudinal axis 15 and the minor center longitudinal axis 16.

Figure 6:
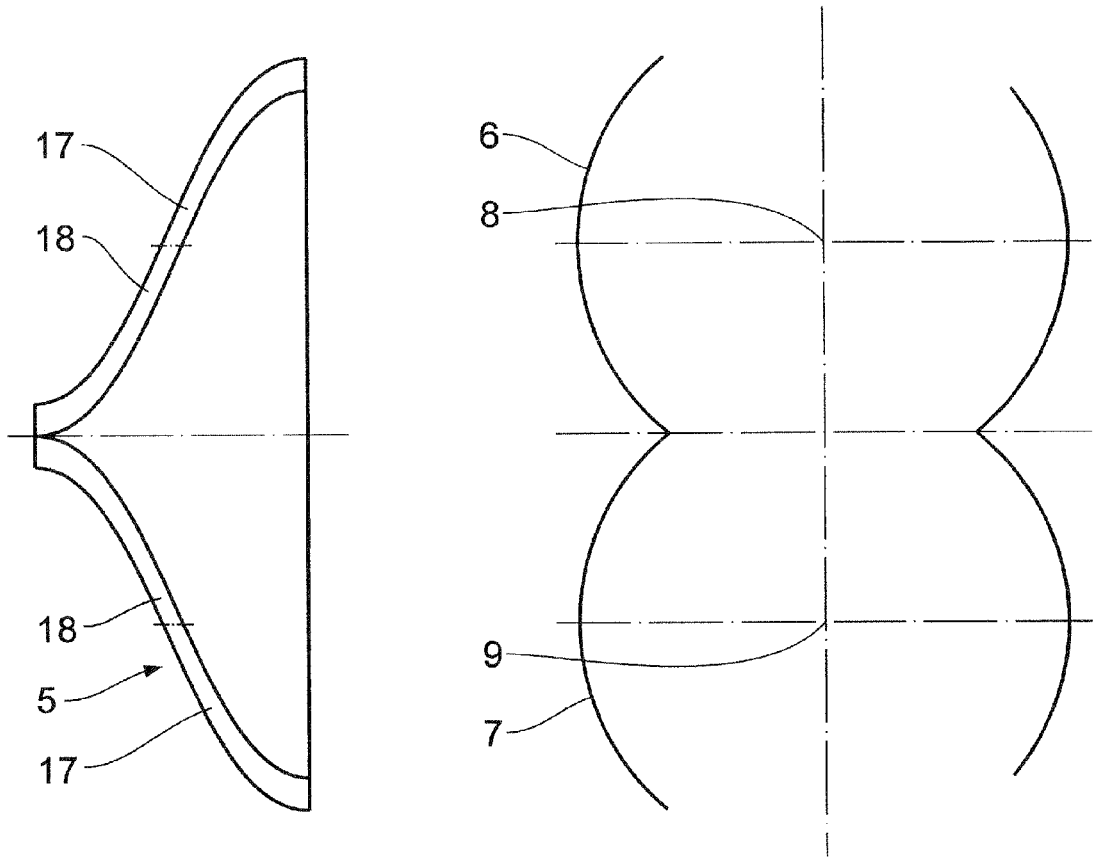
FIG. 6 is a schematic illustration of the configuration and position of the inlet and outlet port respectively.

In FIG. 6 the rotors 6, 7 are outlined on the right, in order to illustrate to the left thereof the position of the outlet port 5—and this applies analogously for the diametrically opposed inlet port 4.

In the exemplary embodiment the inlet port and outlet port 4, 5 are designed trapezoidal, with the trapezoid legs 17 extending in a sine or cosine shape, respectively.

Alternatively, it is possible to design the inlet and outlet port 4, 5, respectively, substantially triangular. In this case, as is also apparent from FIG. 6, the triangle legs 18 are designed sine or cosine shaped as well.

What is claimed is:

1. A rotary pump comprising:

a housing (1) defining a working room in a shape of two intersecting cylinder sections (2, 3), inlet and outlet ports (4, 5) on mutually opposite sides of the housing (1), and in each cylinder section (2, 3) one of two rotors (6, 7), each rotor (6, 7) being rotatably disposed about its center longitudinal axis (8, 9) and having a major and a minor transverse axis (15, 16) and further having two approximately club-shaped sections that are connected to each other at their narrower ends via a waisting, the rotors (6, 7) having a configuration and being disposed relative to each other such that when the major transverse axes of the two rotors (6, 7) are positioned perpendicular to each other, the club-shaped section of one rotor (6, 7) engages into the waisting of the other rotor (6, 7), wherein the rotors (6, 7) roll off on one another and against the interior wall of the housing (1) in a sealing manner creating in each phase of the rotation movement an evenly increasing intake volume in front of the inlet port (4) and an evenly decreasing discharge volume in front of the outlet port (5), each rotor (6, 7), when viewed along its center longitudinal axis (8, 9), is helically twisted about the longitudinal axis, such that sealing lines (12) are created on an outer surface of each rotor (6, 7) that extend sinusoidally, wherein the rotors (6, 7) engage each other via the corresponding sealing lines (12) at their surfaces which are sinusoidally shaped, wherein said inlet and outlet port (4, 5) comprising legs or lateral edges (17, 18) and being triangular or trapezoidal shaped, said legs or lateral edges (17, 18) of the inlet and outlet port (4, 5) are respectively configured to be sine and cosine shaped.

2. The rotary pump according to claim 1, wherein the corresponding sinusoidal sealing lines (12) are configured to form geometrically linear sealing surfaces.

3. The rotary pump according to claim 1, wherein the corresponding sinusoidal sealing lines (12) are widened to form band-like sealing surfaces.

4. The rotary pump according to claim 3, wherein the rotors (6, 7), viewed in cross-section, have concave bulges (14) on both sides of the major longitudinal axis (15) and on both sides of the minor longitudinal axis (16), respectively.

5. The rotary pump according to claim 1, wherein disposed in each case is an inlet port (4) on the inlet side and an outlet port (5) situated exactly opposite and flush with the inlet port (4).

* * * * *